US006289939B1

(12) United States Patent
Mortensen et al.

(10) Patent No.: US 6,289,939 B1
(45) Date of Patent: Sep. 18, 2001

(54) HIGH CONDUCTIVITY LAUNDER RESISTANT GROUNDING TAPE

(75) Inventors: John A. Mortensen, Little Silver, NJ (US); Russell Fryer, Muncy, PA (US)

(73) Assignee: C. M. Offray & Son, Inc., Chester, NJ (US)

( * ) Notice: Subject to any disclaimer, the term of this patent is extended or adjusted under 35 U.S.C. 154(b) by 0 days.

(21) Appl. No.: 09/645,281

(22) Filed: Aug. 24, 2000

(51) Int. Cl.[7] ..... D03D 15/02

(52) U.S. Cl. ..... 139/22; 139/425 R; 139/116.1; 139/450; 139/420 R

(58) Field of Search ..... 139/425 R, 11, 139/1 R, 116.1, 450, 191, 291 R, 383 R, 387 A, 420 R, 22

(56) References Cited

U.S. PATENT DOCUMENTS 3,288,175 * 11/1966 Valko ..... 139/425
3,422,460 * 1/1969 Burke et al. ..... 2/73
3,586,597 * 6/1971 Okuhashi ..... 161/87
3,722,440 * 3/1973 Igarashi et al. ..... 112/475.09
3,851,456 * 12/1974 Hamada et al. ..... 57/238
3,882,667 * 5/1975 Barry ..... 57/362
4,557,968 * 12/1985 Thornton et al. ..... 442/198
4,664,158 * 5/1987 Sands ..... 139/422
5,324,579 * 6/1994 Sassa et al. ..... 442/324

* cited by examiner

*Primary Examiner*—John J. Calvert
*Assistant Examiner*—Robert H. Muromoto, Jr.
(74) *Attorney, Agent, or Firm*—Barry G. Magidoff; Paul J. Sutton

(57) ABSTRACT

A fabric grounding tape and method of making same is disclosed. In accordance with the method the tape is woven on a needle loom using polyester and stainless steel warp yarns. The yarns are maintained under tension during and after the weaving process and are subjected to a heat setting procedure while still under tension. The resultant tape has the hand or feel of a conventional all polyester tape and a low ohmic resistance, i.e. 10 ohms or less per inch. The tape can sustain a multiplicity of laundering cycles without significant increase of resistivity.

6 Claims, 2 Drawing Sheets

HIGH CONDUCTIVITY LAUNDER RESISTANT GROUNDING TAPE

BACKGROUND AND FIELD OF THE INVENTION

The present invention is directed to a high conductivity grounding tape used in connection with garments worn in so-called "clean rooms".

It is well recognized in the industry that in the manufacture of certain sensitive electronic components i.e. "chips", that even low voltage charges can permanently damage the chips at certain stages of their manufacture. By way of example, operators of manufacturing equipment can produce several hundred volts of static electricity merely by minor movements of their arms.

In order to dissipate voltages as low as those noted, it is imperative that the grounding, voltage dissipating conductor have a high conductivity factor.

While a pure wire conductor will provide the requisite low resistance, it is desirable, and in most instances imperative that the grounding conductor exhibit the "hand" or feel of a conventional fabric.

Numerous attempts have been made to create a fabric-like tape which will exhibit the necessary high conductivity and "hand" demanded by industry and which also will maintain these characteristic through multiple laundering cycles. By way of example, clean room, static dissipating garments are expected to be capable of withstanding a hundred or more washings in deionized and hence highly reactive water, without material increase in the resistance of the grounding tape.

Attempts to provide a tape having the above desired characteristics have included incorporating in the fabric metal clad polymer yarns i.e. yarns coated with silver, copper, etc. The tapes fabricated from clad yarns fail to satisfy the laundering requirements since the ohmic resistance exhibited increases progressively from washing to washing.

Tapes have been formed of yarns impregnated with conductive materials such as carbon. However, carbon filled yarns possess an electrical resistance thousands of times greater than that required in many "clean room" environments.

PRIOR ART

Without conceding the relevance thereof to the instant invention, there is cited below patent references located in the course of studies.

U.S. Pat. No. 4,664,158 assigned to the applicant herein is directed to a grounding fabric for a wrist strap wherein conductive components are raised from the surface of the fabric. A similar disclosure is embodied in 4,577,256.

U.S. Pat. No. 4,557,968 discloses an electrostatic dissipating fabric for making into garments, the conductivity being afforded by carbon doped yarns.

U.S. Pat. No. 3,288,175 discloses a textile material incorporated conductive yarn ends.

U.S. Pat. No. 3,422,460 disclosures a static inhibiting cloth which avoids clinging to the wearer.

U.S. Pat. No. 3,479,565 discloses a circuit board for electronic components made of a woven matrix.

U.S. Pat. No. 3,586,597 discloses a cloth for use in garments employing a conductive fiber having finely divided articles of conductive material therein.

U.S. Pat. No. 3,706,195 teaches a synthetic yarn having conductive carbon which is longitudinally extendible to a high degree before breaking.

U.S. Pat. No. 3,851,456 is directed to anti-static yarn comprised of a mixture of metallic and non-metallic fibers, the metallic fibers including stainless steel.

U.S. Pat. No. 3,882,667 is directed to a composite textile yarn formed of non-metallic yarns and a blended yarn plied with non-metallic yarns, the blended yarn being formed of metallic and non-metallic fibers.

U.S. Pat. No. 3,971,202 is directed to an anti-static yarn particularly useful to form carpets, the yarn being obtained by cobulking non-conductive and conductive yarns.

U.S. Pat. No. 3,986,530 is directed to a knitted or woven cloth having anti static properties including electrically conductive threads composed of metal plated natural or synthetic fibers and metallic filaments.

U.S. Pat. No. 4,045,949 is directed to an integral electrically conductive textile filament including a multiplicity of electrically conducting longitudinally directed strata of fiber-forming polymer material. Conductivity is provided by carbon black.

U.S. Pat. No. 4,064,075 is directed to a highly conductive extrudable material embodying electrically conductive carbon black.

U.S. Pat. No. 4,145,473 relates to an anti-static filament having a polymeric sheath and a conductive polymer core.

U.S. Pat. No. 4,332,082 relates to an anti-electrostatically grounded suiting material. Conductivity is provided by carbon black coated monofiliment fibers.

U.S. Pat. No. 4,296,855 is directed to a conductive fabric especially adapted for use as a controlling antenna on a conveyor belt. Carbon particles provide conductivity.

U.S. Pat. No. 4,357,390 is directed to an anti static polyester fiber, the fiber being hollow.

SUMMARY OF THE INVENTION

The present invention may be summarized as directed to a method of manufacturing a tape and to the resulting tape characterized in that the tape has a low ohmic resistance, e.g. less than 2 ohms per inch, exhibits the "hand" or feel of a conventional textile, and which may be subjected to a multiplicity of washings (well over 100) without any significant loss in conductivity.

It is noted that attempts have been made by applicant on an experimental basis to weave tapes comprised of polymeric yarns and continuous filiments of metal i.e., stainless steel. Initial such attempts have proven to be failures. More particularly, the ohmic resistance of the tape would increase dramatically in the course of handling and washing.

We have discovered, that the loss of conductivity of conventionally woven tapes comprised of polymeric yarn ends and stainless ends is a result of a rupture of the stainless ends, the rupture being occasioned by a differential shrinkage of the polymer and stainless yarns. More particularly, microscopic examination of such tapes reveal the formation of a multiplicity of kinks in stainless yarns. We have theorized that the kinking results from the fact that polymer yarns stretch by a factor of 40 or more times the stretch exhibited by stainless yarns when the yarns are woven together under normal tension parameters.

We have discovered that the kinking with consequent loss of conductivity can be avoided by a unique departure from conventional weaving procedures, namely the polymer and stainless yarns are woven under tension and are removed from the loom while still under tension. The tension in the yarns is continuously maintained after weaving and is maintained until the tape is subjected to a heat setting procedure during which the tendency of the polymer yarns to shorten is removed. The resulting tape evinces the hand or feel of comparable tapes woven entirely of polymer yarns. The tape has been subjected to well over 100 cycles of washing with no significant loss of conductivity. In this connection it is noted that clean room garments are washed in deionized water. This material is more reactive as respects silver or copper clad yarn ends and accounts for the rapid loss of conductivity observed in grounding tapes employing clad yarns. It is noted that conventional weaving procedure is essentially the opposite of the practice described in patents such as U.S. Pat. No. 4,664,158 wherein conductive yarns are woven together with distended elastic yarns. Upon release of tension the conductive yarns are deflected away from the surface of the woven tape to ensure contact with the skin of the user as a result of foreshortening of the elastic yarns.

It is accordingly an object of the invention to provide a highly conductive tape having the "hand" of a conventional tape, the tape being susceptible of a multiplicity of laundering cycles without material increase in the ohmic resistance of the tape.

A further object of the invention is the provision of a method of manufacturing a conductive tape having the above described characteristics.

DETAILED DESCRIPTION OF DRAWINGS

Figure 1:
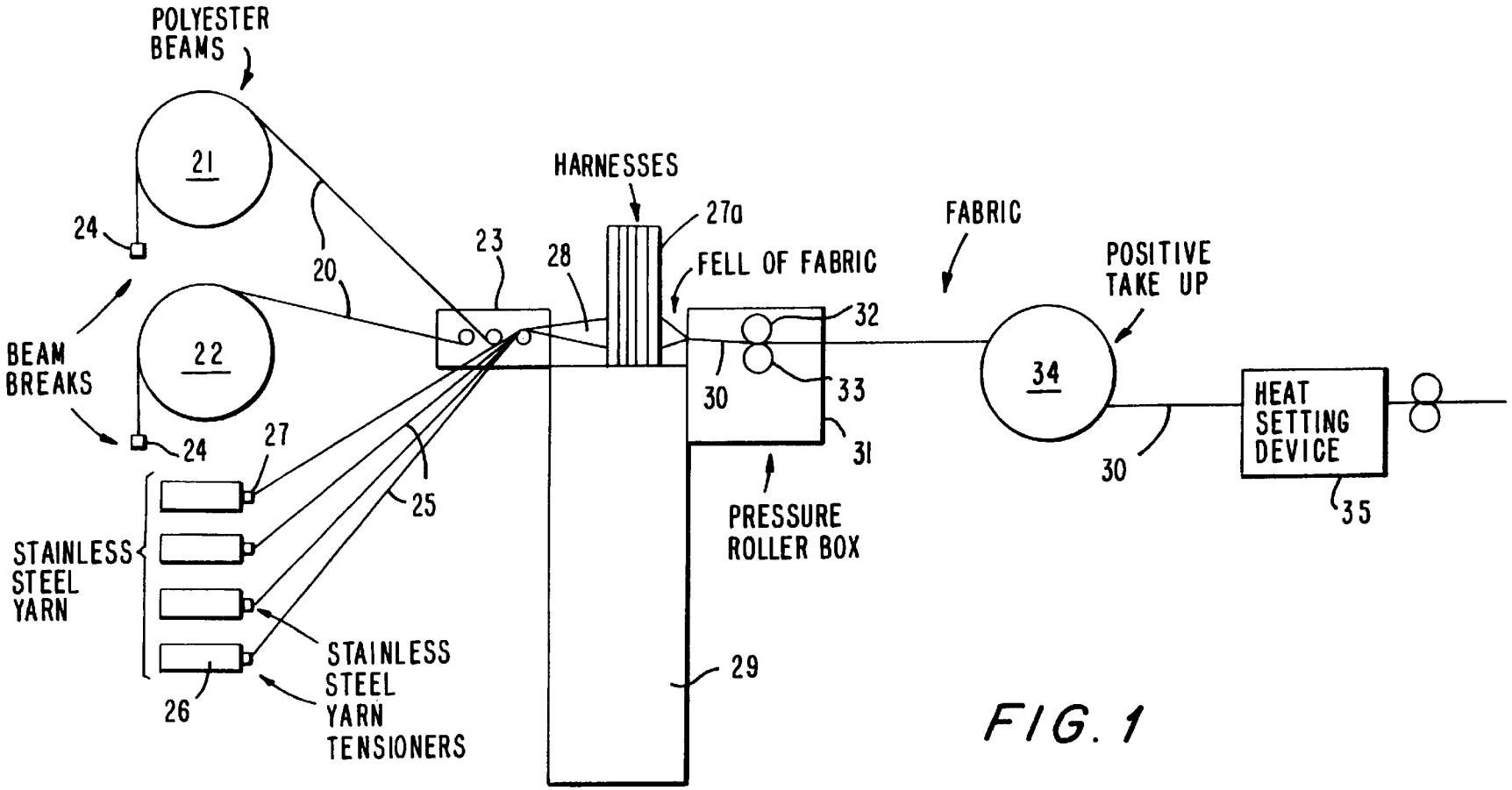
FIG. 1 is a schematic representation of the mechanisms for practicing the method of the invention.

The schematic of FIG. 1 represents an essentially conventional needle loom device. Polyester warp yarn ends 20 are fed from beams 21, 22 through a conventional lease rod station 23. The beams 21, 22 are mounted for rotation, the beams being subjected to a frictional drag through the use of beam brakes 24. The brakes may comprise cords or ropes riding in grooves on the side of the beam.

Stainless steel yarns ends 25 are fed from spools 26 to the lease rod station 23. The stainless yarn ends are fed through tensioners 27 which exert a frictional drag on the yarns.

The stainless and polymer yarns are fed through harnesses 27*a* whereat filling yarns F are inserted through the fell 28 in a conventional manner. The woven tape 30 is maintained under tension, passing through a pressure roller box 31 schematically illustrated as incorporating mating drive rollers 32, 33. The formed tape is wound under tension on positive take up roll 34. Importantly, the tape is maintained under tension throughout the process, it being preferable to maintain the tape on the take-up roller 34 under tension for subsequent processing. It is also feasible for the tape 30 be fed directly from the loom to the heat setting device 35. Preferably, the tape is maintained under tension on roller 34 and subsequently processed to account for the differential in speed of the feed of the tape during weaving in the needle loom 29 and the speed of the feed within the heat setting device.

EXAMPLES

In order to comply with the best mode requirements of the patent laws there is noted below the specific parameters for the formation of a one-quarter inch and a three-eighths inch wide tape width.

A quarter inch width tape was woven, the warp being comprised of 79 yarn ends namely 75 polyester ends and four stainless steel yarns.

Suitable ground and filling yearns F surrounding the stainless comprised single ply polyester, yarn diameter 4 mils, 1/70/34.

The stainless steel yarns were supplied by the Bekaert Corporation type NV 14/2×90/175S/316T being 2 ply twisted yarn (175 Turns/meter) 14 micron filament diameter, yarn diameter 10 mils.

Optionally, certain regularly spaced filling years F' may comprises stainless yarns exposed, encompassed in, or plied with polyester, although this is a non-preferred embodiment which is necessary only in instances where the tape is subjected to extreme stresses and bends which might rupture the stainless warps.

The yarns were woven on a conventional needle loom. The brake on the beams applies tension to the polyester yarn ends, the tension on the polyester yarns being effected by adjustment of the brake to provide tension of approximately 150 grams per yarn end. The yarn tensioners controlling the stainless yarns are adjusted to supply a tension of approximately 150 grams to each of the stainless ends. It is noted that the tension applied can vary within a significant range it being desirable to apply just sufficient tension to maintain a clear shed at the fell of the loom.

It is mandatory that the tension be maintained as the tape emerges from the loom. To maintain the tension, the tape is passed through the nip of rollers 32,33, of a pressure roller box. It is noted that the arrangement involves a modification of the tape take up device from a conventional negative feed to a positive feed.

The fabric, is wrapped on positive take up roller 34 while still maintaining the tension in the fabric.

It is noted that the total fabric tension in respect of quarter inch width fabric amounts to approximately 11.85 kilograms.

The tension of the tape is maintained throughout the heat setting process. The tensioned tape on take up roll 34 is run at 30 yards per minute over heated cylinders at a surface temperature of 350° Fahrenheit. The tape is exposed to surface heat until the tape reaches a temperature of 225° Fahrenheit. The tape is exposed to the heating process for 8.5 minutes. The tape is then allowed to cool to ambient before the tension is released.

Figure 2:
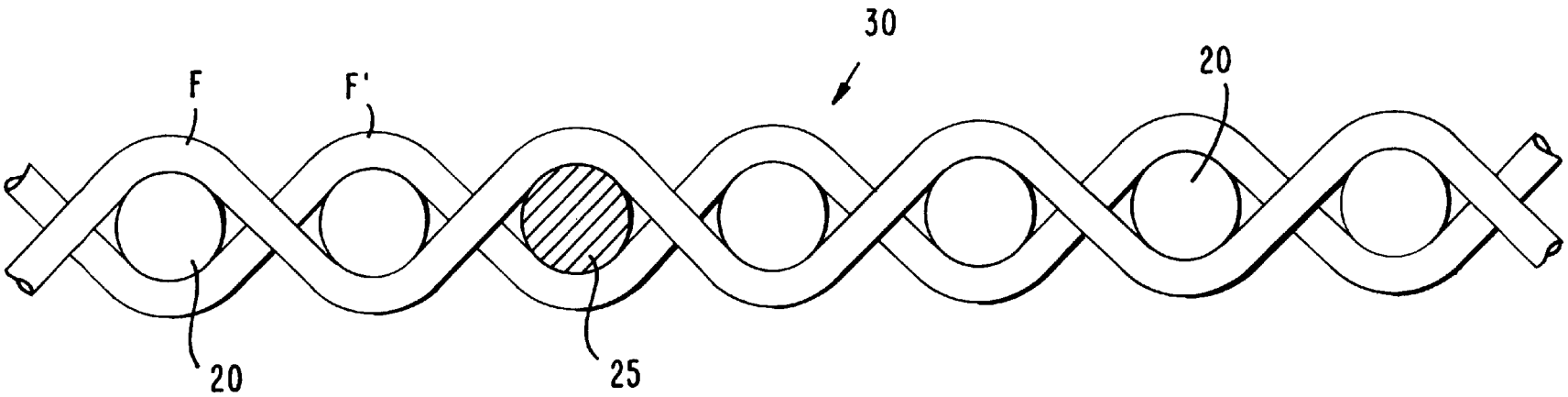
FIG. 2 is a schematic transverse section through a tape in accordance with the invention.

The resulting tape (illustrated in FIG. 2 schematically) evinces a "hand" comparable to that of an all polyester tape. Examination of the tape demonstrates that the stainless yarns are free of kinks of the type which have rendered the use of stainless yarn ends heretofore known to be impracticable. The tapes have been laundered in deionized water for over 100 cycles. The ohmic resistance of the heat set tape has been measured at approximately 0.5 ohms/inch. Following 100 washings in deionized water the ohmic resistance was measured at 2 ohms per inch.

Example 2

A ⅜ inch wide fabric was woven in the manner described above. The warp of the ⅜ inch fabric incorporated a total of 81 polyester and five stainless yarn ends. The fabric tension was maintained at 12.15 kilograms for the ⅜ inch width. The woven tape was subjected to heat setting as described above. The pre-washed ohmic resistance of the ⅜ inch tape was measured at 0.5 ohms per inch, the post 100 launderings measurement of the tape sample was 2 ohms per inch. Desirably, the ratio of polyester to stainless yarn ends is at least about 10 to 1.

While it is feasible to lead the woven tape directly into a heat setting device, it has been found, as a practical matter, to be preferable to wind the tape under the tension on a take up roll (34) for subsequent processing. It is noted that due to the substantial tension in the fabric, it is necessary to employ a take up roll which is capable of resisting the cumulative compressive forces developed in the process.

As will be apparent to skilled workers in the art, variations of the described procedure may be made without departing from the spirit of the invention. By way of example, it may be feasible to employ other means of avoiding shrinkage in the polymeric yarns beside heat setting procedures.

It will be clear that the foregoing description of this invention is for purposes of explanation and illustration. It will be apparent to those skilled in the relevant art that modifications and changes may be made to the invention as above described without departing from its scope and spirit. Accordingly, the invention is to be broadly construed within the scope of the appended claims.

What is claimed is:

1. The method of manufacturing a laundering resistant high conductivity tape comprising the steps of: (a) providing thermoplastic polymer and stainless steel yarns, the ratio of polymer to stainless yarn ends being at least about 10 to 1, (b) advancing said polymer and stainless yarns simultaneously through a fill insertion station of a loom to thereby form a tape, (c) removing said tape from said station, (d) heat setting said polymer yarns (e) cooling said tape, and (f) continuously maintaining said polyester yarn under a tension of at least about 150 grams per yarn during step (b)–(e).

2. The method of manufacturing a laundering resistant high conductivity tape comprising the step of: providing polymeric yarn ends and stainless steel yarns, with the ratio of polymer yarns to stainless yarns being at least about 10 to 1, said polymer yarns being about 30 times more distensable than said stainless yarns, providing a needle loom, advancing a plurality of side by side polymer yarns through the fill insertion mechanism of said needle loom while longitudinally tensioning said yarns at about 150 or more grams per yarn end, simultaneous advancing said stainless yarns through said fill insertion station, said stainless yearns intervening between said polymer yarns, said stainless yarns being longitudinally tensioned at about 150 or more grams per stainless end, and removing the tape emerging from said loom while continuously maintaining the tension thereon, thereafter subjecting said tensioned tape to heat at a temperature and for a time period sufficient to set said polymer yarns, and thereafter cooling said tape.

3. An article of manufacture comprising a conductive tape having the hand or feel of a conventional tape, an ohmic resistance of less than 10 ohms per inch, said tape being susceptible to at least 100 laundering cycles without significant loss of conductivity, said tape comprising polyester warp yarn ends and stainless steel warp yarn ends in ratio of at least about 10 polyester ends to one stainless end, the polyester ends being heat set.

4. An article in accordance with claim 3 having fill yarn ends comprised of stainless steel.

5. A high conductivity tape for use as an electrical conductor having the hand or feel of a conventional tape, an ohmic resistance of less than 10 ohms per inch, said tape being susceptible to at least 100 laundering cycles without significant loss of conductivity, said tape comprising polyester warp yarn ends and stainless steel warp ends in a ratio of at least about 10 polyester ends to one stainless end, and the polyester ends being heat set.

6. A high conductivity tape for use as an electrical conductor having the hand or feel of a conventional tape, an ohmic resistance of less than 10 ohms per inch, said tape being susceptible to at least 100 laundering cycles without significant loss of conductivity, said tape comprising polyester warp yarn ends and stainless steel warp ends in a ratio of at least about 10 polyester ends to one stainless end, and the polyester ends being heat set.

* * * * *